United States Patent [19]

Vaughn

[11] Patent Number: 4,685,662

[45] Date of Patent: Aug. 11, 1987

[54] PIPE ALIGNMENT APPARATUS

[76] Inventor: Millard A. Vaughn, 1713 S. Park Side Dr., Deer Park, Tex. 77536

[21] Appl. No.: 834,571

[22] Filed: Feb. 28, 1986

[51] Int. Cl.[4] ..... B25B 1/20

[52] U.S. Cl. ..... 269/43; 269/48.1

[58] Field of Search ..... 269/43, 48.1; 279/2 R; 242/72, 72.1

[56] References Cited

U.S. PATENT DOCUMENTS

| | | | |
|---|---|---|---|
| 2,226,078 | 12/1940 | Spahn | 269/48.1 |
| 2,546,950 | 3/1951 | Nixon | 279/2 |
| 2,920,837 | 1/1960 | Wingard | 242/72.1 |
| 3,742,186 | 6/1973 | Finkel et al. | 269/48.1 |
| 3,963,250 | 6/1976 | Flagg | 269/48.1 |
| 3,986,383 | 10/1976 | Petteys | 269/48.1 |

*Primary Examiner*—Robert C. Watson

*Attorney, Agent, or Firm*—Bill B. Berryhill

[57] ABSTRACT

Pipe alignment apparatus comprising: a tubular mandrel having a central bore therethrough, the opposite ends of which terminate in outwardly diverging first and second frusto-conical surfaces, the mandrel being divided into a plurality of longitudinal sections, allowing the mandrel to be radially expanded. A rod member extends through the central mandrel bore. First and second axially spaced frusto-conical members are carried on the rod and are axially movable toward each other upon manipulation of the rod member to wedgedly engage the first and second frusto-conical surfaces, respectively, effecting radial expansion of the mandrel for firmly engaging the interior of first and second pipe sections to effect the axial alignment thereof.

9 Claims, 3 Drawing Figures

PIPE ALIGNMENT APPARATUS

BACKGROUND OF THE INVENTION

1. Field of the Invention

The present invention pertains to pipe,flange and fitting alignment apparatus. Most specifically, it pertains to apparatus for aligning the ends of two sections of pipe or pipe and fittings to be joined together by welding or the like.

2. Description of the Prior Art

When sections of pipe are welded together, it is important that the sections to be welded together are properly aligned on a common central axis. If not properly aligned faulty welds may occur. Even if a good weld is obtained, improper alignment of the pipe sections may result in a joint weakened to bending stresses and internal pressures.

Most alignment of pipe for welding is performed manually, using jacks and levels. This is particularly true for larger pipe sizes. Although various pipe alignment tools have been developed, they have found limited use because of ineffectiveness or difficulty of use. Thus, the need continues for effective and easy to use pipe alignment apparatus.

SUMMARY OF THE INVENTION

In the present invention, pipe alignment apparatus is provided which is effective and easy to use for aligning the ends of two sections of pipe. The apparatus includes a tubular mandrel which has a central bore therethrough and which is divided into a plurality of sections. The opposite ends of the bore terminate in outwardly diverging first and second frusto-conical surfaces. A rod member extends through the central mandrel bore and at least one end of the rod member may extend through one of the pipe sections for manipulation thereof. First and second axially spaced frusto-conical members are carried on the rod and are axially movable toward each other upon manipulation of the rod member to wedgedly engage the first and second frusto-conical surfaces of the central bore to effect radial expansion of the mandrel for firm engagement with the interior of the pipe sections, thus effecting the axial alignment thereof.

In an alternate embodiment of the invention, a second tubular member is carried around the first tubular mandrel for accommodating the joining of sections of larger diameter pipe. The second tubular mandrel, like the first, is divided into a plurality of longitudinal sections which allows the second tubular mandrel to be expanded by radial expansion of the first tubular mandrel. Additional mandrels of larger diameter may be carried around the first mandrel.

Thus, the present invention provides pipe alignment apparatus which is easily insertable into two sections of pipe for aligning the pipe for the joining thereof by welding and the like. Not only is the apparatus easy to use, it is effective in obtaining accurate alignment. Other objects and advantages of the invention will be understood from reading the description which follows in conjunction with the accompanying drawings.

DESCRIPTION OF THE PREFERRED EMBODIMENTS

Figure 1:
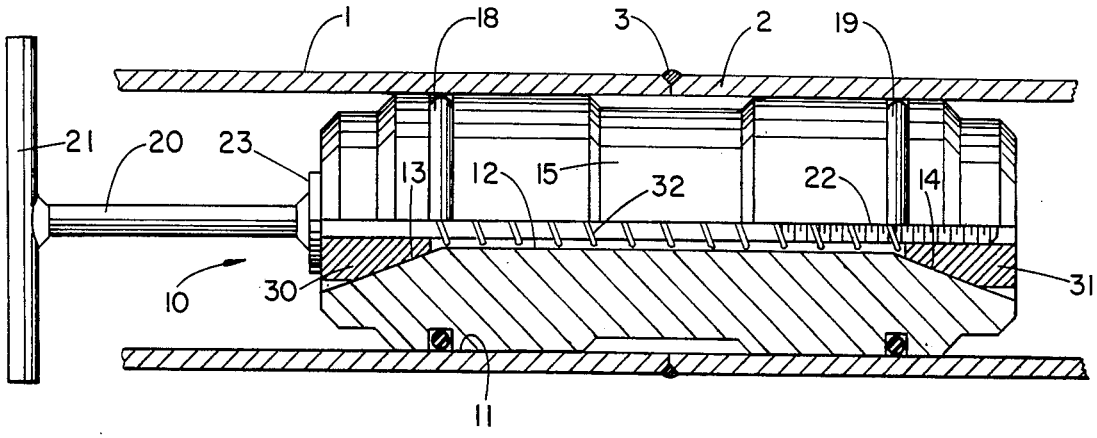
FIG. 1 a longitudinal view of pipe aligning apparatus, according to a preferred embodiment of the invention, partially in section, showing the apparatus inserted into the ends of the two sections of pipe for the welding thereof.
Figure 2:
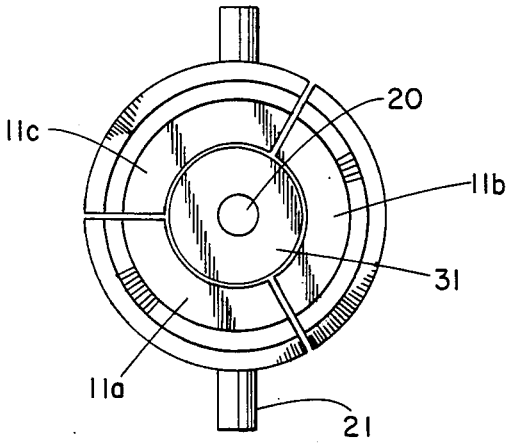
FIG. 2 is an end view of the pipe alignment apparatus of FIG. 1.

Referring first to FIGS. 1 and 2, there is shown two sections of pipe 1 and 2 abutted together for joining by welding at 3. Placed in the ends of the pipes 1 and 2 for alignment thereof, prior to welding, is pipe alignment apparatus 10 which includes a tubular mandrel 11 having a central bore 12 therethrough. The opposite ends of the bore 12 terminate in outwardly diverging first and second frusto-conical surfaces 13 and 14. The mandrel 11 is divided into a plurality of longitudinal sections 11*a*, 11*b*, and 11*c*. This may by accomplished by axially saw-cutting a piece of solid bar of aluminum, or other suitable material, at 120° angles, after having bored the center of the bar and taper bored the ends to provide the bore 12 and frusto-conical surfaces 13 and 14. The segments 11*a*, 11*b*, and 11*c* are held together about rod 20 by resilient rings or springs 18 and 19 placed in groves provided therefor. The exterior of the tubular mandrel 11 is relieved to form an annular recess 15 substantially midway of the opposite ends of the mandrel 11 so that the exterior of the mandrel 11 does not engage the pipe sections 1 and 2 at the ends thereof. It may also be relieved, as shown, at the ends thereof for welding convenience.

A rod member 20 extends through the mandrel bore 12 and at least one end of the rod member may extend through one of the pipe sections 1 for manipulation thereof. To assist in manipulation of the rod 20 a handle 21 may be attached thereto. In the embodiment of FIGS. 1 and 2, the rod is threaded at one end thereof 22 and provided with a stop shoulder 23 at a specified distance therefrom.

Carried by the rod member 20 are first and second axially spaced frusto-conical members 30 and 31. In the embodiment of FIGS. 1 and 2, the first frusto-conical member 30 is centrally bored with a diameter sightly greater than the rod 20 so as to freely slide thereon. The second frusto-conical member 31 is bored and internally threaded to threadedly engage the threaded portion 22 of the rod 20. A spring member 32 may be placed around the rod 20 to urge the frusto-conical members 30 and 31 apart.

When first assembled, the outside diameter of the mandrel 11 is slightly less than the internal diameter of the pipe sections 1 and 2. The pipe alignment apparatus 10 is then inserted through the pipe sections so as to be properly disposed as shown in FIG. 1. Then the rod 20 is manipulated, in this case rotated, causing the frusto-conical member 31 to threadedly advance along the threaded portion 22 of the rod 20. Thus, the first and second axially spaced frusto-conical members 30 and 31 move toward each other, wedgedly engaging the first and second frusto-conical surfaces 13 and 14, respectively, and causing radial expansion of the mandrel 11 until it firmly engages the interior of the first and second pipe sections 1 and 2. This, of course, would cause the axial alignment of the pipe sections 1 and 2 about a common central axis. When this is accomplished, the pipe sections can be welded together, as at 3. Since there is a relieved area at 15, the possibility of welding the pipe to the mandrel is precluded. After welding, the rod 20 is manipulated (rotated in the opposite direction) to separate the frusto-conical members 30 and 31, under the influence of spring 32, allowing the mandrel 11 to contract for removal from the pipe sections 1 and 2.

Figure 3:
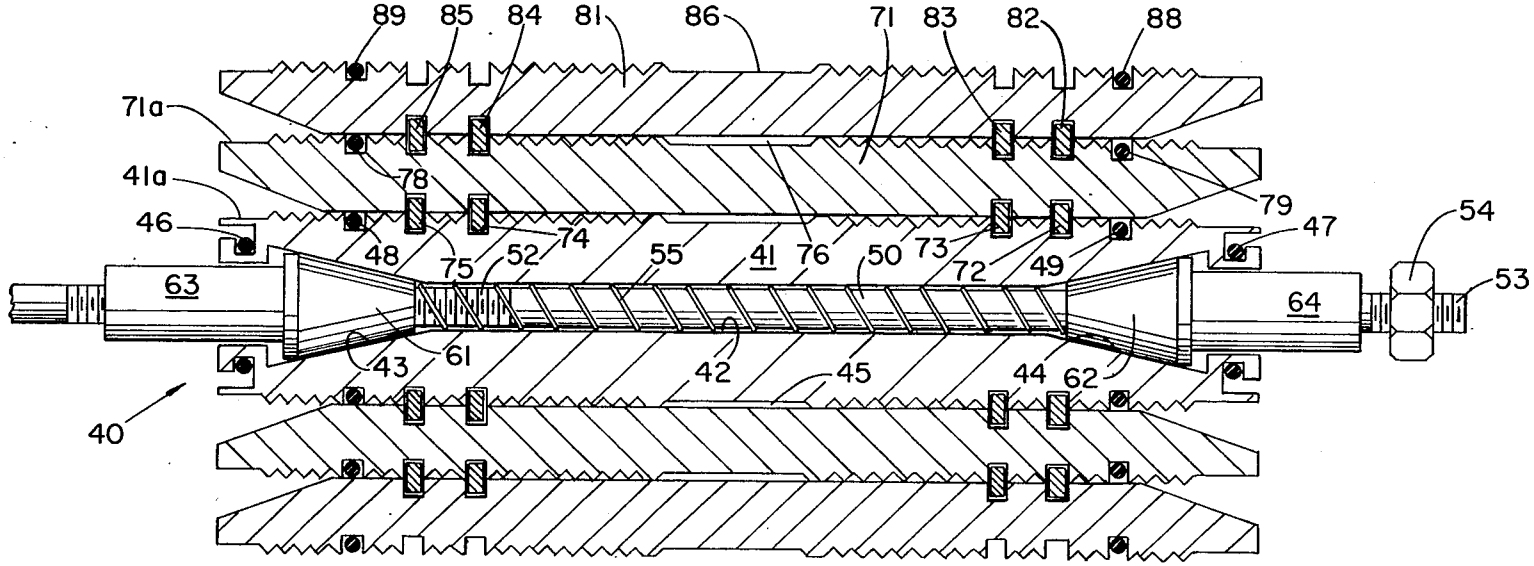
FIG. 3 is a longitudinal view, in section, of pipe aligning apparatus, according to an alternate embodiment of the invention.

Referring now to FIG. 3, an alternate embodiment of the invention is shown which is designed for utilization with different diameters of pipe and for welding one diameter pipe to another. Like in the previous embodiment, the pipe alignment apparatus 40 comprises a tubular mandrel 41 which may be divided into a plurality of longitudinal sections, allowing the mandrel 41 to be radially expanded. The mandrel 41 is provided with a central bore 42 at the opposite ends of which are first and second frustoconical surfaces 43 and 44. Grooves are provided around the mandrel 41 for receiving means for holding the mandrel sections together. These means may include rings 48 and 49. If desired, end grooves may also contain springs or other members 46 and 47 for holding the mandrel sections together. As in the previous embodiment, a relieved area 45, substantially midway between the opposite ends of the mandrel 41 may be provided so that the exterior of the mandrel does not engage any pipe in which it may be placed. The external surface of the mandrel 41 may be threaded as at 41*a* so as to provide a friction-engaging surface and to allow trash and dirt to be forced into grooves so the alignment will not be thrown off.

Like in the previous embodiment, a rod member 50 extends through the central mandrel bore 42 and carries thereon a pair of frusto-conical members 61 and 62, which may include cylindrical extensions 63 and 64, respectively. In the embodiment of FIG. 3, frusto-conical members 62 have a smooth bore which slides on the rod 50. One of the members 61, 62 could be internally threaded to threadedly engage a threaded section 52 of the rod 50. In this particular embodiment, the rod 50 is also threaded on the end at 53 to receive a nut 54. A spring 55 may be placed around the rod 50.

Utilizing only the portions of the pipe alignment apparatus 40 just described, the mandrel 41 may be inserted into the inner diameter of two sections of pipe whose internal diameters are slightly greater than the diameter of mandrel 41. The rod 50 can be rotated, causing the frusto-conical members 61 and 62 to be drawn together, expanding the mandrel 41 for firm engagement with the pipe so that welding at the joining thereof may take place.

The pipe alignment apparatus 40 is also designed for utilization with pipe of larger internal diameter. For this reason, it may be provided with a second mandrel 71 and even a third mandrel 81. The second tubular mandrel 71 is carried around the first mandrel 41 and may also be divided into a plurality of longitudinal sections, allowing the second tubular mandrel 71 to be radially expanded upon radial expansion of the first tubular mandrel 41. To insure proper alignment of the second tubular mandrel 71 with the first 41, corresponding radial holes may be provided in each mandrel to accept pins 72, 73, 74, and 75. This assures proper alignment and engagement of the second mandrel 71. The second mandrel 71 may be provided with threads or frictional engagement means 71*a* and may also be relieved to form an annular recess 76 substantially midway the opposite ends of the mandrel 71. Springs or rings 78 and 79 may be provided for holding the second mandrel 71 around the first mandrel 41.

The third mandrel 81 is obviously for accommodating larger diameter pipe and may also be divided into a plurality of longitudinal sections allowing the third tubular mandrel 81 to be radially expanded by radial expansion of the first and second mandrels 41 and 71. Radial pins 82, 83, 84 and 85 assure proper alignment. Springs 88 and 89 hold the mandrel 81 in place around the second mandrel 71. A relieved recess 86 is provided substantially midway the opposite ends of the mandrel 81.

It will be noted that the inside diamenter of outer mandrels 71 and 81 are tapered allowing these mandrels to be used independently if larger frusto-conical members are substituted for members 61 and 62. It should also be noted that the outside diameter of each of the mandrels 41, 71, and 81 can be different at opposite ends so that slightly differing diameter pipe can be joined; e.g., schedule 40 pipe joined to schedule 80 pipe.

Thus, it can be seen that the pipe alignment apparatus of the present invention is relatively simple and easy to operate. As illustrated, particularly in FIG. 3, the apparatus can be made to accomodate different diameter pipe sections. While several embodiments of the invention have been described herein, many variations can be made without departing from the spirit of the invention. Accordingly, it is intended that the scope of the invention be limited only by the claims which follow.

I claim:

1. Apparatus for aligning the ends of two sections of pipe and or fittings to be joined together, said apparatus comprising:

a first tubular mandrel having a central bore therethrough, the opposite ends of said bore terminating in outwardly diverging first and second frusto-conical surfaces, said first mandrel being divided into a plurality of longitudinal sections, allowing said mandrel to be radially expanded;

a rod member extending through said central mandrel bore and at least one end of which may extend through one of said pipe sections for manipulation thereof;

first and second axially spaced frusto-conical members carried on said rod, said first and second frusto-conical members being axially movable toward each other upon said manipulation of said rod member wedgedly engaging said first and second frusto-conical surfaces, respectively, to effect radial expansion of said first mandrel for firmly engaging the interior of said first and second pipe sections and causing the axial alignment thereof; and a second tubular mandrel which may be carried around and first tubular mandrel for accommodating the joining of sections of larger diameter pipe, said second tubular mandrel divided into a plurality of longitudinal sections allowing said second tubular mandrel to be radially expanded by radial expansion of said first tubular mandrel.

2. Pipe aligning apparatus as set forth in claim 1 in which the exterior of said tubular mandrels are relieved to form an annular recess substantially midway of opposite ends of said mandrels so that the exterior of said mandrels do not engage said pipe sections at the ends thereof to be joined together.

3. Pipe aligning apparatus as set forth in claim 1 in which said first mandrel includes at least three of said longitudinal sections which in cross-section form at least three segments of approximately 120° or less.

4. Pipe aligning apparatus as set forth in claim 1 including means for holding said mandrel sections together around said rod member.

5. Pipe aligning apparatus as set forth in claim 4 in which said means for holding said mandrel sections together comprises at least one ring of resilient material for placement in a groove provided around said tubular mandrel sections.

6. Pipe aligning apparatus as set forth in claim 5 in which said ring is a spring member biasing said mandrel sections inwardly toward said rod member.

7. Pipe aligning apparatus as set forth in claim 1 in which at least one of said axially spaced frusto-conical members is provided with a centrally bored and threaded hole threadedly engaging a threaded portion of said rod member, so that rotation of said rod member, relative to said one of said frusto-conical members, effects said axial movement of said frusto-conical members toward each other.

8. Pipe aligning apparatus as set forth in claim 1 in which the outer surfaces of said tubular mandrels are grooved to provide frictional engagement with said pipe sections and to provide areas for collecting of impurities.

9. Pipe aligning apparatus as set forth in claim 1 in which said first and second tubular mandrels are provided with corresponding radial holes in which pins are placed for alignment of said second tubular mandrel with said first tubular mandrel.

* * * * *